United States Patent [19]

Pulichino, Jr. et al.

[11] Patent Number: 4,854,431

[45] Date of Patent: Aug. 8, 1989

[54] SUITCASE WITH COMPARTMENT FOR A FOLDABLE GARMENT BAG

[75] Inventors: John V. Pulichino, Jr., Providence, R.I.; Joy Tong, New York, N.Y.

[73] Assignee: American Tourister, Inc., Warren, R.I.

[21] Appl. No.: 199,424

[22] Filed: May 27, 1988

[51] Int. Cl.[4] ..... A45C 3/00; A45C 13/02; B65D 85/18

[52] U.S. Cl. ..... 190/108; 190/110; 190/111; 190/112; 206/280; 206/287.1

[58] Field of Search ..... 206/280, 287, 287.1; 190/109, 108, 110–112; 150/113

[56] References Cited

U.S. PATENT DOCUMENTS

| | | | |
|---|---|---|---|
| 2,175,387 | 10/1939 | Goding | 206/280 |
| 2,325,806 | 8/1943 | Simmons | 190/111 X |
| 2,418,589 | 4/1947 | Lifton | 190/111 X |
| 2,918,997 | 12/1959 | Kotkins | 190/111 X |
| 2,964,149 | 12/1963 | Smallberg | 190/111 |
| 3,448,839 | 6/1969 | Lugash | 190/111 X |
| 3,559,777 | 2/1971 | Gardner | 190/111 X |
| 4,206,835 | 6/1980 | Shapiro | 190/108 |
| 4,236,657 | 12/1980 | Brunton | 190/111 X |
| 4,244,453 | 1/1981 | Herz | 206/287 X |
| 4,580,667 | 4/1986 | Herwood | 190/110 |

*Primary Examiner*—Sue A. Weaver

*Attorney, Agent, or Firm*—Wood, Herron & Evans

[57] ABSTRACT

A carryon suitcase having two compartments. A garment bag is twice folded upon itself and packed in one of the compartments.

11 Claims, 4 Drawing Sheets

SUITCASE WITH COMPARTMENT FOR A FOLDABLE GARMENT BAG

BACKGROUND OF THE INVENTION

This invention relates to a suitcase and more particularly to a suitcase and garment bag combination.

The packing and carrying of clothes so that they arrive at the destination in a relatively wrinkle-free condition has taxed the ingenuity of people who travel as well as people who design luggage for the people who travel. Attempts to provide wrinkle-free packing having resulted in suitcases or travel containers of a wide variety of designs.

The most simplistic of these designs involves a suitcase compartment into which the garments are folded. Tissue paper or plastic film can be employed between layers of garments to minimize wrinkling.

In another form of suitcase, an interior partition is provided over which the garment can be folded.

In another mode of packing, suits or dresses are packed in a separate garment bag while other articles of clothing and shoes are packed in the suitcase, the two being carried separately. Attempts have been made to attach the garment bag to the suitcase itself.

In still another form, the garment bag has been significantly enlarged and provided with compartments for articles of clothing other than the dresses and suits. This enlarged, elongated bag, when packed, is folded upon itself.

In still another garment bag type of luggage, a rigid pole projects through the middle of the garment bag and two suits are adapted to be hung on one side of it. Also hanging from the pole are compartmented sheets of material that hold shirts, socks and underwear.

Each of the foregoing designs has its advantages and disadvantages. The objective of the present invention has been to provide an improved suitcase that carries dresses or suits in the interior of the suitcase in a relatively wrinkle-free manner.

This objective of the invention has been attained by providing a suitcase having two compartments and a garment bag which is twice folded upon itself and mounted in one of the compartments.

The invention is primarily intended for weekend carryon luggage that is about 22×16×9 inches in overall dimension. It is to be understood that the concept of the invention can be employed with luggage of larger sizes. Further, it is preferred that the invention be applied primarily to soft-sided luggage, but it is to be understood that it could be employed with hard-sided luggage as well.

The suitcase has an internal partition that divides the suitcase into two compartments, one being about twice the size of the other. The smaller compartment contains the garment bag.

The garment bag itself has a rigid strap across its top. One side of the strap has a chain and hook, permitting the strap and its bag to be hung from a door or conventional bar in a closet. To the other side of the strap, within the confines of the garment bag, are hung one or more removable hangers, such as conventional wire hangers, for the garments.

The garment bag is preferably provided with mating Velcro fasteners at its lower edge and two-thirds of the length from the lower edge so as to permit the lower third of the garment bag to be folded upon the middle third of the garment bag and secured.

The relationships described herein have a number of advantages. To appreciate them, it is important to visualize the packing process. The empty garment bag is hung over the door. The rigid, horizontal strap holds the garment bag against sagging. Garments are placed on the removable hangers and hung on the eyelet provided on the rigid strip within the garment bag.

With the clothes hanging naturally and free of wrinkles, the bottom third of the garment bag is folded up and secured over the middle third of the garment bag. The folded bottom is then folded upon itself and the three ply garment bag is placed carefully in the small compartment of the suitcase provided for it. The rigid strap is attached to the upper edge of its compartment so that there will be no sagging within the garment bag. The outer wall of the suitcase is then zipped closed.

Because the garments were hanging by gravity in a wrinkle-free condition and thereafter folded about the walls of the garment bag, they will tend to remain wrinkle-free. The garment bag provides some stiffness to the folded pack, thereby preventing the bag and garments from sagging or crumpling upon itself within the suitcase compartment. The pack is packed compactly within the suitcase thereby facilitating the handling of the suitcase. The garments are protected by the outside walls of the suitcase.

At the destination, the garment bag can simply be hung, with the garments in it, on the bar of a closet. Preferably, however, the garments should be taken out of the garment bag and hung, by means of the hangers furnished with the garment bag, on the closet bar. Thus, if there are any incipient wrinkles, they should be quickly dissipated by the free hanging clothes.

If the volume of clothes to be carried is greater than can easily be accommodated in the larger compartment of the suitcase, such articles can be packed in both compartments and the garment bag can be carried as an extra item of luggage. Thus, the carryon luggage, suitable in normal operations for a long weekend, can be expanded into a two-piece luggage set for a longer stay.

The several features and objectives of the present invention will become more readily apparent from the following detailed description taken in conjunction with the accompanying drawings in which.

Figure 2:
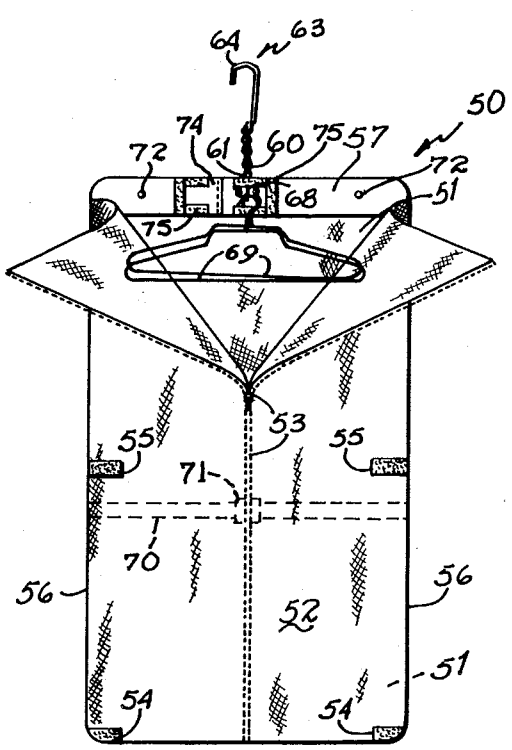
FIG. 2 is a front elevational view of the garment bag that is carried with the suitcase of FIG. 1, the garment bag being drawn at about one-half the scale of the suitcase.
Figure 1:
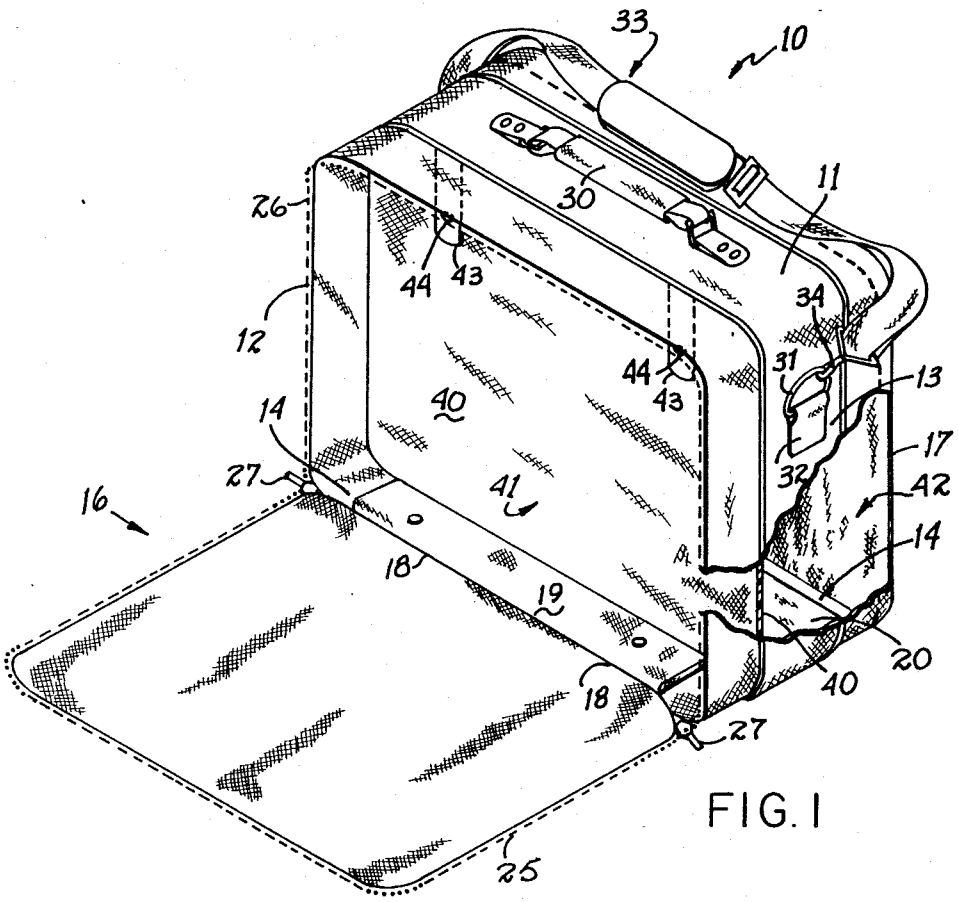
FIG. 1 is a perspective view of the suitcase with which the present invention is employed.

Referring to FIG. 1, a suitcase 10 has a top wall 11, side walls 12 and 13 and a bottom wall 14. The suitcase has a front panel 16 and a back panel 17 that enclose the top, bottom and side walls. The panels 16 and 17 are connected by flexible plastic hinges 18 to the bottom wall 14. Rigid reinforcement elements 19 and 20 lie across the bottom wall to give the suitcase form and to help prevent the front and back panels from closing in on and crushing the garments contained with the suitcase.

Each front and back panel 16 and 17 has a slide fastener element 25 around its free edges and the side and top walls have cooperating slide elements 26 around their free edges. A pair of slide fasteners 27 are provided to join the slide elements and close the suitcase by zipping up the front and back walls.

The top wall has a conventional handle 30 riveted to it. The side wall has rings 31 connected by straps 32 connected to the side walls. An adjustable shoulder strap 33 is connected by removable fastener clips 34 to the shoulder strap.

A partition 40 connected at its edges to the top, bottom and side walls lies parallel to the front and back walls and divides the suitcase into a small compartment 41 and a large compartment 42 about twice the size of the small compartment. The small compartment has a pair of straps 43 having female snap fasteners 44 on their ends adapted to receive a garment bag.

The garment bag is indicated at 50 in FIGS. 2, 5, 6 and 7. The garment bag has a back wall 51 and a front wall 52. The front wall is vertically divided into two sections at its center and is adapted to be closed by a slide fastener 53. At the lower edge of the garment bag, the front wall has a pair of Velcro fastener elements 54. A second pair of cooperating Velcro fastener elements 55 are mounted about two-thirds the distance from the bottom edge to facilitate folding the garment bag.

The front and back walls of the garment bag are a vinyl plastic. A two-inch gusset 56 is preferably provided along each vertical side to keep the walls of the bag from squeezing down on the garments contained therein.

Figure 5:
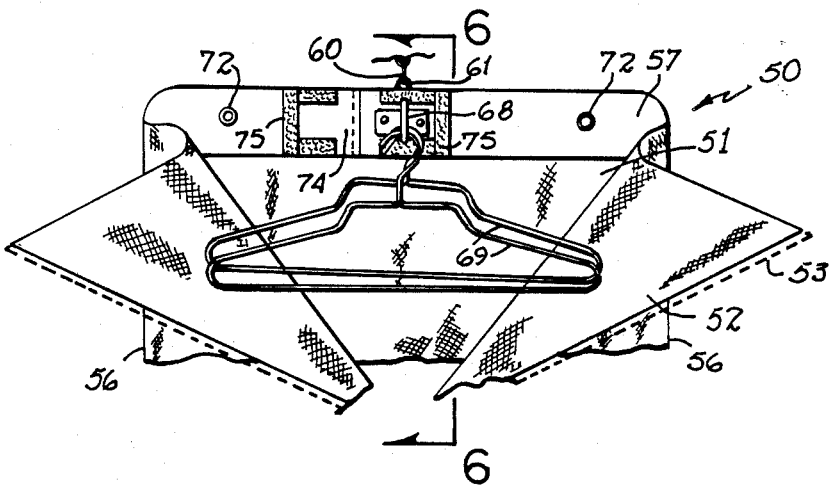
FIG. 5 is a partial front view of the top section of the garment bag.
Figure 6:
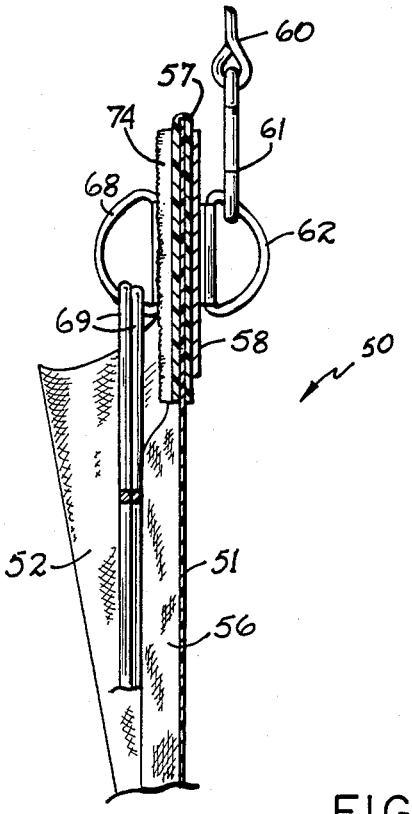
FIG. 6 is a partial cross-sectional view taken on lines 6—6 of FIG. 5.

Referring to FIGS. 5 and 6, a pair of heavy flexible vinyl straps 57 are stitched to the thin upper edge of the rear wall 51 of the garment bag. Those straps 57 are reinforced by a rigid, thin bar 58 that is riveted to the heavy vinyl straps.

A chain 60 (FIGS. 2 and 7) is connected by a removable clip 61 to a ring 62 on the rigid strap 58 outside the garment bag. The hook 63 has an enlarged upper end 64 that permits it to be hooked over a door for convenience in packing.

On the inside of the garment bag, a ring 68 is provided. A pair of coated wire hangers 69 are removably mounted on the ring 68 and are adapted to hold two garments such as two suits each having a jacket and pants.

A strap 70 and buckle 71 combination is fixed horizontally across the interior of the bag about midway between the top and bottom edges.

In the illustrated form of the invention, the suitcase is nine inches wide, sixteen inches high and twenty-two inches long. The garment bag is forty-one inches long and twenty-one inches wide.

The bag, when filled with garments, can be folded upon itself twice, and thus into thirds, by first connecting the Velcro fasteners to make the first fold and thereafter folding that two-ply section upon that top third of the bag to make the second fold. Thus folded, the garment bag is carefully laid into the compartment 41. The heavy vinyl strap 57 is connected to the snap fasteners 44 by means of male counterparts 72 to secure the garment bag within the compartment 41 against sagging.

Figure 4:
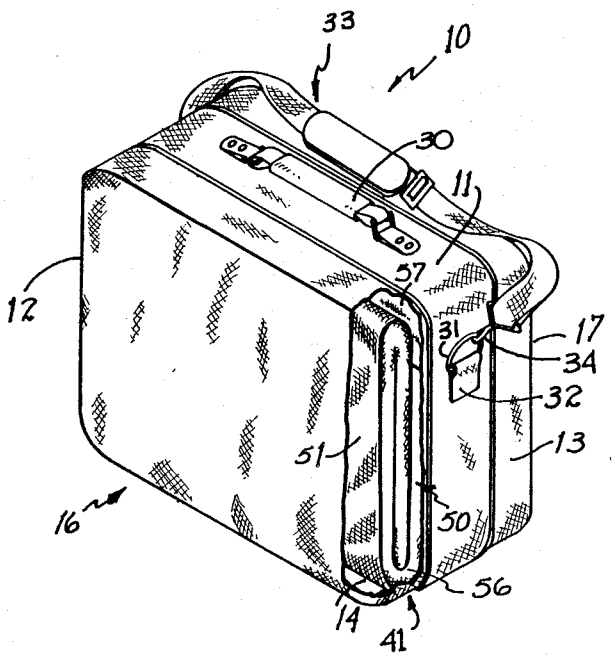
FIG. 4 is a perspective view partly broken away of a completely packed garment bag and suitcase combination.
Figure 3:
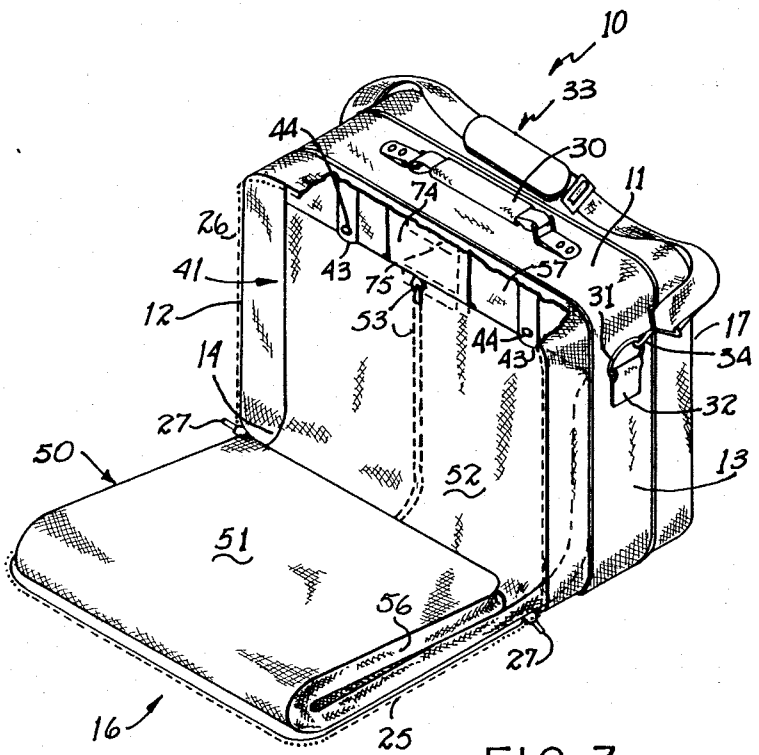
FIG. 3 is a perspective view of the suitcase with the garment bag partly inserted into its compartment.
Figure 7:
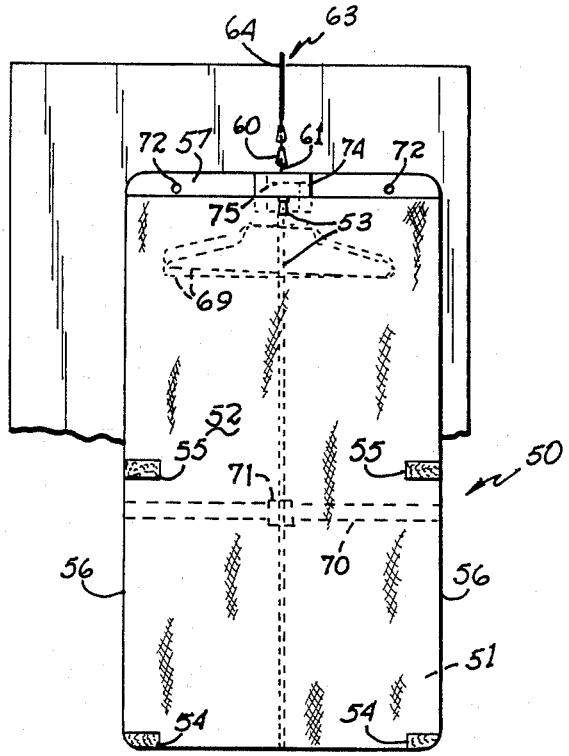
FIG. 7 is a front view of the garment bag being packed.

In the operation of the invention, as shown in FIG. 7, the garment bag is preferably hung from a door by means of the hook 63. The slide fastener 53 is fully opened. Garments are hung on the hangers 69 and the hangers are placed through the ring 68. Gravity causes the garments to hang freely and wrinkle-free at this stage of the packing procedure. The strap 70 may be buckled around the garments at this point. The slide fastener 53 is raised to close the garment bag around the garments. The lower edge of the garment bag is carefully raised and Velcro fastener elements 54 are joined to elements 55 to provide the first fold of the garment bag. Thereafter, that two-ply section is folded upon the top third of the garment bag and the bag and contents are carefully laid into the compartment 41. Alternatively, the garment bag with the lower third folded prior to the final fold may be inserted in the case as shown in FIG. 3 and thereafter folded to the FIG. 4 position. The hook 63 can be placed inside the garment bag and maintained free from movement by a strap 74 and its Velcro fastener 75. Snap fasteners 44 secure the upper edge of the garment bag in the compartment 41. The front wall 16 is folded over the now-filled compartment and zippers 27 are operated to close the compartment 41.

Preferably, the compartment 42 has been previously packed in a conventional manner. The suitcase is now ready for travel.

At the destination, the front panel is open to permit the removal of the garment bag. The garment bag is then hung directly over the bar in a closet or hung on a door associated with the closet while the garments are removed and hung by their hangers freely in the closet of the carrier's destination.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A suitcase comprising, a generally rectangular container, a partition dividing said container into two compartments, a full length garment bag having at least one clothes hanger, said garment bag consisting of an elongated fabric sheath for enclosing a suit or dress and including means for opening said bag while it is unfolded with a garment hanging freely in it and thereafter closing said bag upon a garment, said garment bag being folded upon itself in one of said compartments, means in said one compartment for securing said garment bag in said compartment, and means in said container for providing access respectively to said two compartments.

2. A suitcase as in claim 1 in which the dimensions of said suitcase are approximately 22 inches by 16 inches by 9 inches, said garment bag having two folds creating three sections.

3. A suitcase as in claim 1 in which said container is soft luggage having a front wall and a back wall parallel to said front wall, said partition being generally parallel to said front and back walls, said access means being flexible panels forming a portion of said front and back walls, and zippers connecting said panels to said walls.

4. A suitcase as in claim 1 wherein said securing means comprises, a rigid strap across the top of said garment bag, means for attaching said strap to one end of said suitcase.

5. A suitcase as in claim 4 further comprising, a bag hook connected to the center of said strap for hanging said garment bag and contents, and at least one clothes hanger removably attached to said strap.

6. A suitcase as in claim 1 in which the compartment for said garment bag is approximately one-third the width of said container.

7. A suitcase comprising, a generally rectangular container having spaced parallel front and back walls, and top, bottom and side walls connected between said front and back walls, a partition parallel to said front and back walls dividing said container into a small garment bag compartment and a large article compartment, a garment bag folded upon itself twice to form three sections and disposed in said garment bag compartment, said garment bag consisting of an elongated fabric sheath for enclosing a suit or dress and including means for opening said bag while it is unfolded with a garment hanging freely in it and thereafter closing said bag upon a garment, a rigid strap and hook mounted across the top of said garment bag, means for removably mounting said strap across the top of said suitcase, and a clothes hanger and hook removably mounted to said strap.

8. A suitcase as in claim 7 further comprising, a first pair of laterally-spaced Velcro fastening elements mounted approximately one-third the length of said bag from the top of said bag, and a second pair of laterally-spaced Velcro fastening elements mounted on the bottom edge of said bag to facilitate folding the bottom portion of said bag.

9. A suitcase as in claim 7 further comprising, longitudinal gussets of approximately two inches width formed in the side edges of said garment bag.

10. A suitcase as in claim 7 further comprising, a transverse internal strap connected across the central portion of said garment bag.

11. A suitcase comprising, a generally rectangular container, a partition dividing said container into two compartments, a full length garment bag having at least one clothes hanger, said garment bag having an upper edge and an external bag hanger connected to said upper edge for hanging said garment bag while said clothes hanger supports clothes within said bag, said garment bag being folded upon itself in one of said compartments, means in said one compartment for securing said garment bag in said compartment, and means in said container for providing access respectively to said two compartments.

* * * * *